US006515423B1

(12) United States Patent
Schlager et al.

(10) Patent No.: US 6,515,423 B1
(45) Date of Patent: Feb. 4, 2003

(54) HIGH-PRESSURE DISCHARGE LAMP

(75) Inventors: Walter Schlager, Bocholtz (NL); Ghaleb Natour, Aachen (DE); Xaver Riederer, Aachen (DE)

(73) Assignee: Koninklijke, Philips Electronics N.V., Eindhoven (NL)

( * ) Notice: Subject to any disclaimer, the term of this patent is extended or adjusted under 35 U.S.C. 154(b) by 287 days.

(21) Appl. No.: 09/709,267

(22) Filed: Nov. 9, 2000

(30) Foreign Application Priority Data

Nov. 11, 1999 (EP) ..... 99203771

(51) Int. Cl.[7] ..... H01J 17/20

(52) U.S. Cl. ..... 313/639; 313/620; 313/621; 313/631

(58) Field of Search ..... 313/639, 640, 313/637, 631, 632, 643, 620, 621

(56) References Cited

U.S. PATENT DOCUMENTS 5,668,441 A * 9/1997 Genz ..... 313/637
5,712,530 A * 1/1998 Inoue et al. ..... 313/620
6,051,929 A * 4/2000 Genz et al. ..... 313/639
6,437,508 B1 * 8/2002 Sugihara et al. ..... 313/632

FOREIGN PATENT DOCUMENTS

EP 0714118 A1 5/1996 ..... H01J/61/86
EP 0910111 A2 4/1999 ..... H01J/61/82

* cited by examiner

*Primary Examiner*—Robert H. Kim
*Assistant Examiner*—Elizabeth Gemmell
(74) *Attorney, Agent, or Firm*—Dicran Halajian

(57) ABSTRACT

The high-pressure discharge lamp comprises a lamp vessel (1) in which an anode (4) and a cathode (5) are disposed spaced apart by an electrode distance D of 1–2 mm, the anode (4) having a tip (9) with a blunt end surface S. The area of the end surface S in $mm^2$ and the lamp current I in amperes satisfy a relationship according to which $0.09 \leqq S/I \leqq 0.16$, with $3.5 \leqq I \leqq 8.0$ amperes. The ionizable filling containing metal halide comprises an amount of mercury between 65–125 $mg/cm^3$. The power range of the lamp is between 200 and 400 watts. The calculated power gap ratio, PGR=P/D, is over 120 W/mm. The lamp is suitable for comparatively high brightness applications and at the same time is comparatively stable and has a comparatively long life.

6 Claims, 1 Drawing Sheet

HIGH-PRESSURE DISCHARGE LAMP

Figure 1:
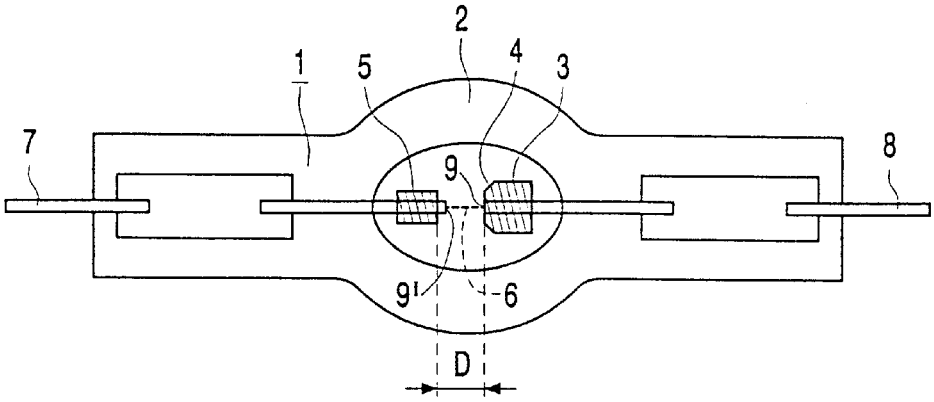

The invention relates to a high-pressure discharge lamp comprising:

a quartz glass lamp vessel closed in a gastight manner and having a wall surrounding a discharge space;

a filling comprising mercury and metal halides in the discharge space;

an anode and a cathode disposed in the discharge space, defining a discharge path, spaced apart by an electrode distance D, and connected to current feed-throughs which extend from the discharge space through the wall of the lamp vessel to the exterior, the anode having a tip with a blunt end surface S;

a lamp current I through the discharge path of the lamp, the lamp current I being defined as:

$$I=P/V$$

wherein

P is the nominal power of the lamp in watts and

V is the lamp voltage in volts;

a power gap ratio PGR, being defined as:

$$PGR=P/D$$

wherein

P is the nominal power of the lamp in watts and

D is the electrode distance D in mm.

Such a lamp is known from EP-A-0 714 118. In the known lamp, an amount of mercury of 50 mg/cm$^3$ is added to the discharge space filling. The known lamp has an average power of 250 W and an average voltage of about 66 V. The lamp current I during stable operation of the lamp is about 3.8 amperes, the anode of the lamp has a tip with a diameter of 0.5 mm, resulting in an S/I ratio of 0.051 mm$^2$/A. The known lamp is a DC lamp and is used for projection applications, for example liquid crystal projection. In this application, the quartz glass lamp vessel, quartz glass being a glass having an $SiO_2$-content of at least 95% by weight, is mounted in an optical unit/system which directs the light, for example a reflector having a focal point. The main requirement of high-pressure discharge lamps used for projection applications is a high luminance. A high luminance can be attained by concentrating a high input power in a lamp with a short discharge path, which means that the PGR is comparatively high. This can be understood from the fact that a substantial portion of the discharge path is in, or at least adjacent to, the focal point of the reflector then. Other requirements for high-pressure discharge lamps used for projection applications are high screen lumens, a good system maintenance, a stable discharge path, and that the burner should stay clear over life, i.e. blackening and wall attack should be reduced to an acceptable level. The known lamp has the disadvantage that it has an electrode distance in the range of 2.5–3 mm and a lamp power in the range of 125–250 W. This means a PGR range of only 40–80 W/mm. Thus, a comparatively large electrode distance of 3 mm makes the known lamp comparatively unsuitable for lighting systems with high optical requirements because substantial portions of the discharge path are out of the focal point of the reflector. However, to overcome the disadvantage of the large electrode distance, a mere decrease in the electrode distance leads to new drawbacks of the lamp, for example an increased corrosion of the anode and/or instability of the discharge path, hence the risk of early failure of the lamp.

It is an object of the invention to provide a high-pressure discharge lamp of the kind described in the opening paragraph in which the above-mentioned disadvantages are counteracted.

According to the invention, this object is achieved with a high-pressure discharge lamp of the kind described in the opening paragraph, which is characterized in that the end surface area S in mm$^2$ and the lamp current I in amperes satisfy a relationship according to which $0.09 \leqq S/I \leqq 0.16$, with $3.5 \leqq I \leqq 8.0$ amperes;

the filling comprises an amount of mercury of between 65 and 125 mg/cm$^3$;

the electrode distance is between 1 and 2 mm; and the PGR is at least 120 W/mm.

Experiments revealed that the lamp of the invention as defined by the wording of the claim taken as a totality of mutually dependent features fulfills the object of the invention. For example, an S/I ratio that is smaller than the given range, for example owing to a decrease in the end surface area S of the anode or an increase in the lamp current I, will lead to a too high temperature of the anode at its end surface, see table 1.

TABLE 1

| Lamp no. | S in mm$^2$ | I in amperes | S/I in mm$^2$/A | $T_{end\ surf.}$ in K |
|---|---|---|---|---|
| L1 (ref.) | 0.65 | 5 | 0.13 | 3000 |
| L2 | 0.20 | 5 | 0.04 | 3200 |

This temperature of the anode is regarded as too high because it will subsequently lead to an increased corrosion of the anode at its end surface. The material thus released from the corroded anode will deposit on the wall of the lamp vessel and cause blackening of the wall. Then not only the lumen efficacy of the lamp will decrease but the risk of a shorter lamp life is increased as well. If the S/I ratio is greater than the given range, there is an increased risk of instability of the discharge path. Instability of the discharge path is observed as flicker which is umpleasant to the human eye. The flicker means that the point of attachment of the discharge path migrates over the end surface of the anode, hence the position of the discharge path will vary. When the lamp is built into a reflector having a fixed focal point, there is an increased risk that at least some of the time the discharge path will be outside the focal point of the reflector, leading to loss of light. Instability of the discharge path and the resulting flicker are also likely to occur if only the electrode distance (or gap) is increased in the known lamp. The risk of instability of the discharge path is not increased when an increase in the amount of mercury per unit volume, i.e. in the operating pressure, and a decrease in the electrode distance are effected together with an adjustment of the end surface S of the anode in accordance with the given relationship with the lamp current I.

To enable high brightness applications of the lamp, comparatively high values of the luminance of the lamp are required. The luminance L in the center of the discharge path is directly proportional to the lamp power P and inversely to proportional electrode distance D according to: L (P/D), P/D is the PGR. A typical average power consumption and a typical average voltage for lamps according to the invention in general are 200–400 W and 50–60 V, respectively. Combined with the electrode distance D of between 1 and 2 mm, comparatively high values of at least 120 W/mm and even up to 200 W/mm for the PGR are feasible. Because of these comparatively high values of the PGR, the required comparatively high values of the luminance L are obtained.

An embodiment of the high-pressure discharge lamp is characterized in that the filling comprises a halogen-containing emitter, for example a gas-phase emitter. The halogen is chosen from the group consisting of chlorine, bromine and iodine. Emitters that yield good results are alkaline bromides and to a somewhat lesser degree lanthanide bromides. The emitter lowers the temperature needed for the cathode to deliver electrons. Without emitter, lamp currents of 4 to 6 amperes require tungsten cathode temperatures of 3000 to 3600 K, whereas in the presence of an emitter, e.g. $DyBr_3$, tungsten cathode temperatures of 2200 to 2800 K are sufficient for establishing the same current.

A favorable embodiment of the high-pressure discharge lamp according to the invention is characterized in that the filling comprises InBr and $SnBr_2$. Due to its filling which contains rare-earth metal or halides of rare-earth metals, a high-pressure discharge lamp is often liable to the corrosion of its quartz glass wall. Corrosion of the quartz glass wall increases the risk of early failure of the lamp. Leaving out or diminishing the amount of the rare-earth materials and the use of InBr and $SnBr_2$ as main components of the discharge filling instead reduces the risk of corrosion of the quartz glass wall. The use of the emitters LiBr, NaBr and KBr instead of $DyBr_3$ leads to a further decrease in corrosion of the quartz glass wall, despite a moderate increase in the temperature of the cathode. If $DyBr_3$ is replaced by NaBr or LiBr, the color temperature of the lamp is lower owing to a stronger yellow/red light emission by Na or Li. Table 2 shows the characteristic properties at zero lamp life with different emitters.

TABLE 2

| | L3 | L4 | L5 | L6 | L7 | L8 |
|---|---|---|---|---|---|---|
| Filling | Hg, InBr, $SnBr_2$, Ar | Hg, Ar, InBr | Hg, InBr, $SnBr_2$, Ar | Hg, InBr, $SnBr_2$, Ar | Hg, InBr, $SnBr_2$, Ar | Hg, InBr, $SnBr_2$, Ar |
| Emitter | NaBr | $DyBr_3$ | no | LiBr | NaBr | KBr |
| Power (W)/gap (mm) | 250/1.5 | 250/1.5 | 400/2 | 400/2 | 400/2 | 400/2 |
| Eff. at 0 hr (lm/W) | 65 | 55 | 65 | 66 | 71 | 62 |
| Color temperature | 5000 | 6500 | 8500 | 6000 | 5000 | 6300 |

In all the lamps having a gas-phase emitter in the filling, the electrode distance increases comparatively slowly and the discharge remains comparatively stable. On the other hand, the lamp without a gas-phase emitter suffered from significant cathode corrosion leading to a comparatively fast increase in the electrode distance. Due to the combination of a gas phase emitter and a filling comprising $SnBr_2$ and InBr, the lamp vessel remained clear and as a result a comparatively good system maintenance was obtained for lamps having a gas-phase emitter in the filling.

As is shown in table 2, the lumens per Watt value (Im/W) of the lamp having NaBr as a gas-phase emitter is comparatively high. This is due to the emission of sodium at about 590 nm. However, this emission cannot be used for data/video projection lamps based on a red-green-blue system because this emission is in between red and green. So the lamp with NaBr apparently has a system efficacy which is about equal to the system efficacy of the lamps having a different gas-phase emitter. It is however, arbitrary to quantify the system efficacy, since it depends to a large extent on the kind of optical system chosen.

It was surprisingly found that the use of KBr as a gas-phase emitter gave a further significant reduction in the corrosion of the quartz glass wall of the lamp vessel in comparison with the corrosion of the quartz glass wall of lamps having the gas-phase emitters of e.g. NaBr or LiBr. Furthermore it appeared that if the current feed-throughs comprise a molybdenum foil, it is particularly this foil which is corroded in the lamp. Again, the lamp having KBr as a gas phase emitter gave a significant decrease in attack of the current feed-through. In particularly, a decrease in corrosion of its molybdenum foil was observed in comparison with lamps having LiBr or NaBr as a gas-phase emitter. The filling comprising InBr, $SnBr_2$, and Li/Na/K halides and mercury was found to be non-aggressive towards tungsten.

Another embodiment of the high-pressure discharge lamp according to the invention is characterized in that the anode and cathode have tips which consist essentially of pure tungsten. Experiments revealed that the use of essentially pure tungsten, i.e. non-doped material known as "ZG tungsten", results in a comparatively low rate of corrosion of the quartz glass wall. Use of the Al-K-Si doped material known as "WD tungsten" or thorium-doped tungsten material, increased the risk of a comparatively high rate of quartz glass wall corrosion, visible as white spots on the quartz glass wall. This was also observed in the case of thorium-doped tungsten, despite the fact that the thorium-doped tungsten material offers the advantage of a lower work function of the anode, hence a lower temperature of the anode.

In an embodiment, the high-pressure discharge lamp according to the invention is characterized in that the lamp is secured to a lamp cap, the current feed-throughs being secured to respective contacts of the cap. The lamp cap may have means, e.g. protrusions, for cooperation with an optical system, e.g. a reflector, which has receiving means, for example, for receiving said protrusions in an abutting manner. It is possible by these means to arrange the discharge path in a predetermined position without the need to align the lamp with respect to the system.

A miniature DC discharge lamp for comparatively small projection applications is known from EP 910 111, e.g. for the illumination of light valves up to 1.5 inches. This miniature lamp has a discharge path of 0.8–1.5 mm and consumes an average power in the range of 40–60 W, hence the PGR-range is 40–75 W/mm. As a result the lamp has the disadvantages that its screen lumens and luminance L are comparatively low, making it unsuitable for comparatively large projection applications. Increasing the power of the lamp or decreasing the electrode distance will lead to instability of the arc attachment and/or an increased corrosion of the cathode, hence to a decrease in system maintenance.

Figure 2:
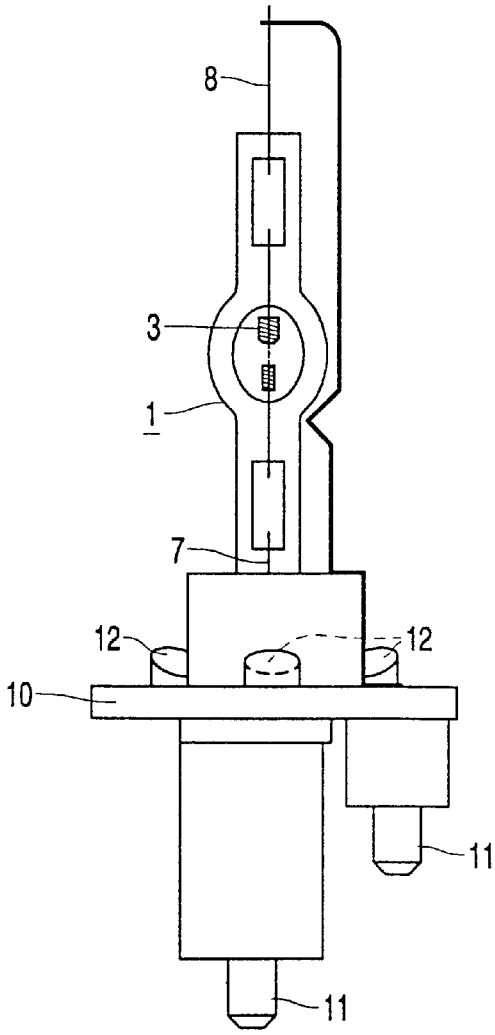

Embodiments of the high-pressure discharge lamp of the invention are shown in the drawing, in which FIG. 1 is an elevation of a lamp;

FIG. 2 is an elevation of a capped lamp.

The high-pressure discharge lamp of FIG. 1 comprises a quartz glass lamp vessel 1 closed in a gastight manner and having a wall 2 surrounding a discharge space 3. An anode 4 and a cathode 5 are disposed in the discharge space 3, defining a discharge path 6, spaced apart by an electrode distance D, and connected to current feed-throughs 7, 8. The current feed-throughs 7, 8 extend from the discharge space 3 through the wall 2 of the lamp vessel 1 to the exterior. The anode 4 has a tip 9 with a blunt end surface S and the cathode 5 has a tip 9', both tips 9 and 9' are made of "ZG tungsten". The discharge space has a volume of 0.38 $cm^3$. The lamp has a filling of 80 mbar argon, 29 mg of mercury, 0.05 mg InBr, 0.23 mg $SnBr_2$ and 0.05 mg of NaBr as a gas-phase emitter. The electrode distance D at 0-hour lamp life is 1.5 mm. The lamp has a rated power of 250 W at 50 V, the lamp current I during stable operation of the lamp is about 5 A. The end surface S has a surface area of 0.65 $mm^2$, the S/I-ratio thus being 0.13 $mm^2/A$. The lamp has a color temperature of about 5000 K and an efficacy of about 65 lm/W. The calculated power gap ratio, PGR, of the lamp is about 165 W/mm.

In the embodiment of FIG. 2, the lamp vessel 1 of FIG. 1 is mounted in a lamp cap 10 having contacts 11 to which respective current feed-throughs 7, 8 are connected. The lamp cap 10 has protrusions 12 which face the discharge space 3. The lamp of this embodiment is well suited for use in an optical system having a ring-shaped spherical surface for receiving said protrusions in an abutting manner in order to arrange the discharge path in the optical system in a predetermined position, without the need to align the lamp with respect to the system.

What is claimed is:

1. A high-pressure discharge lamp comprising:

a quartz glass lamp vessel (1) closed in a gastight manner and having a wall (2) surrounding a discharge space (3);

a filling comprising mercury and metal-halides in the discharge space (3);

an anode (4) and a cathode (5) disposed in the discharge space (3), defining a discharge path (6), spaced apart by an electrode distance D, and connected to current feed-throughs (7, 8) which extend from the discharge space (3) through the wall (2) of the lamp vessel (1) to the exterior, the anode (4) having a tip (9) with a blunt end surface S;

a lamp current I through the discharge path (6) of the lamp, the lamp current I being defined as:

$$I=P/V$$

wherein

P is the nominal power of the lamp in watts and

V is the lamp-voltage in volts;

a power gap ratio PGR, being defined as:

$$PGR=P/D$$

wherein

P is the nominal power of the lamp in watts and

D is the electrode distance D in mm, characterized in that the end surface area S in $mm^2$ and the lamp current I in amperes satisfy a relationship according to which $0.09 \leqq S/I \leqq 0.16$, with $3.5 \leqq I \leqq 8.0$ amperes;

the filling comprises an amount of mercury of between 65 and 125 $mg/cm^3$;

the electrode distance D is between 1 and 2 mm; and the PGR is at least 120 W/mm.

2. A high-pressure discharge lamp as claimed in claim 1, characterized in that the filling comprises a halogen-containing emitter.

3. A high-pressure discharge lamp as claimed in claim 2, characterized in that the gas-phase emitter is chosen from the group consisting of alkaline halides and lanthanide halides, preferably KBr, in which the halide is chosen from the group consisting of chlorine, bromine and iodine.

4. A high-pressure discharge lamp as claimed in claim 1, characterized in that the filling comprises InBr and $SnBr_2$.

5. A high-pressure discharge lamp as claimed in claim 1, characterized in that the anode (4) and the cathode (5) have tips (9, 9') which consist essentially of pure tungsten.

6. A high-pressure discharge lamp as claimed in claim 1, characterized in that the lamp is secured to a lamp cap (10), the current feed-throughs (7, 8) being secured to respective contacts (11) of said lamp cap.

* * * * *